US007955162B2

(12) United States Patent
Boeck et al.

(10) Patent No.: US 7,955,162 B2
(45) Date of Patent: Jun. 7, 2011

(54) GUARD ANTI-ROTATION LOCK DEVICE

(75) Inventors: Cornelius Boeck, Kirchheim (DE); Joachim Schadow, Leinfelden-Echterdingen (DE); Sinisa Andrasic, Schoenaich (DE)

(73) Assignee: Robert Bosch GmbH, Stuttgart (DE)

( * ) Notice: Subject to any disclaimer, the term of this patent is extended or adjusted under 35 U.S.C. 154(b) by 206 days.

(21) Appl. No.: 12/293,386

(22) PCT Filed: Nov. 9, 2007

(86) PCT No.: PCT/EP2007/062120

§ 371 (c)(1),
(2), (4) Date: Sep. 17, 2008

(87) PCT Pub. No.: WO2008/058904

PCT Pub. Date: May 22, 2008

(65) Prior Publication Data

US 2009/0100885 A1 Apr. 23, 2009

(30) Foreign Application Priority Data

Nov. 13, 2006 (DE) ..... 10 2006 053 305

(51) Int. Cl.
*B24B 55/04* (2006.01)

(52) U.S. Cl. ..... 451/451; 451/359; 451/452

(58) Field of Classification Search ..... 451/451, 451/452, 344, 359
See application file for complete search history.

(56) References Cited

U.S. PATENT DOCUMENTS

| | | | | |
|---|---|---|---|---|
| 4,060,940 | A * | 12/1977 | DeWitt | 451/358 |
| 4,574,532 | A * | 3/1986 | Haberle et al. | 451/451 |
| 4,791,541 | A * | 12/1988 | Simmons | 362/376 |
| 4,924,635 | A * | 5/1990 | Rudolf et al. | 451/344 |
| 5,005,321 | A * | 4/1991 | Barth et al. | 451/359 |
| 5,384,985 | A * | 1/1995 | Jacobsson | 451/344 |
| 5,440,815 | A * | 8/1995 | Inkster | 30/390 |
| 5,766,062 | A * | 6/1998 | Edling | 451/451 |
| 6,464,573 | B1 * | 10/2002 | Keller | 451/451 |
| 6,669,544 | B1 * | 12/2003 | Walz et al. | 451/454 |
| 6,699,114 | B1 * | 3/2004 | Booeshaghi et al. | 451/451 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,063,606 | B2 * | 6/2006 | Stierle et al. | 451/359 |
| 7,311,589 | B2 * | 12/2007 | Wiker | 451/451 |
| 2004/0014412 | A1 * | 1/2004 | Hofmann et al. | 451/451 |
| 2006/0052041 | A1 * | 3/2006 | Wiker | 451/451 |
| 2006/0240751 | A1 | 10/2006 | Folin | |

FOREIGN PATENT DOCUMENTS

| | | |
|---|---|---|
| CN | 1729081 | 2/2006 |
| DE | 101 58 334 | 2/2003 |
| DE | 102 59 520 | 7/2004 |
| EP | 0 812 657 | 12/1997 |
| EP | 1 618 990 | 1/2006 |
| WO | 2004/056529 | 7/2004 |

* cited by examiner

*Primary Examiner* — Eileen P. Morgan
(74) *Attorney, Agent, or Firm* — Michael J. Striker

(57) ABSTRACT

The invention relates to a protective hood anti-rotation lock for a portable power tool (12*a-k*), especially for an angle grinder, for providing anti-rotational locking between the portable power tool (12*a-k*) and a protective hood unit (14*a-k*). According to the invention, the protective hood anti-rotation lock has a form-fit unit (16*a-k*) which is provided for anti-rotational locking of the protective hood unit (14*a-k*) in relation to the portable power tool (12*a-k*) in the event of a tool (18*a-k*) breakage.

2 Claims, 10 Drawing Sheets

GUARD ANTI-ROTATION LOCK DEVICE

CROSS-REFERENCE TO A RELATED APPLICATION

The invention described and claimed hereinbelow is also described in German Patent Application DE 10 2006 053 305.4 filed on Nov. 13, 2006. This German Patent Applications, whose subject matter is incorporated here by reference, provide the basis for a claim of priority of invention under 35 U.S.C. 119(a)-(d).

BACKGROUND OF THE INVENTION

An angle grinder with an adjustable guard is made known in EP 812 657 A1. In that case, the guard is adjustable in a rotating manner on a connection piece of a flange of the angle grinder, and is supported such that it may be detachably attached using a single form-fit locking means. The spindle of the angle grinder passes through the center of the flange. A cutting disk and/or grinding disk are/is installed on the free end of the spindle in a clampable, rotationally drivable manner for cutting and machining work pieces, which are partially enclosed by the guard. The guard must be positioned in a rotationally adjustable manner on the hand-held power tool such that the region of the grinding disk that faces the user is enclosed by the guard. At the same time, a region of the grinding disk that points away from the user extends past the flange, radially relative to the region of engagement with the work piece.

SUMMARY OF THE INVENTION

The present invention relates to a guard anti-rotation lock device for a hand-held power tool, in particular for an angle grinder, which is provided to prevent rotation between the hand-held power tool and a guard unit.

It is provided that the anti-rotation lock device includes a form-fit connection unit, which is provided to prevent rotation between the hand-held power tool and the guard unit if a tool should burst. The guard unit is preferably provided to protect an operator—during regular operation of the hand-held power tool—from a tool, in particular from a disk-shaped, rotatably drivable tool, and/or from machining residue that is slung in the direction of the operator, and it is attached to the hand-held power tool in a working position. A "form-fit connection unit" refers, in particular, to a unit that is provided to establish a form-fit connection—that acts in the circumferential direction—between the guard unit and the hand-held power tool, and which is designed to absorb forces of an outwardly-slung tool piece that could occur if a tool should burst. The guard anti-rotation lock device, which in an anti-rotation lock position, is designed to absorb a force of at least 1000 N, advantageously at least 2500 N, and particularly advantageously at least 4500N. To realize an anti-rotation lock of the guard unit on the hand-held power tool, the guard unit, which is attached to the hand-held power tool, may be moved into an anti-rotation lock position by absorbing impulses and/or forces of outwardly-slung pieces of the burst tool. "Provided" is intended to mean, in particular, specially equipped and/or designed. Due to the inventive design of the guard anti-rotation lock device, it is possible to effectively protect an operator of the hand-held power tool from a tool that rotates during operation of the hand-held power tool, and, in particular, from pieces of the tool that are slung in the direction of the operator if the tool becomes damaged, e.g., if the tool should burst.

It is furthermore provided that the form-fit connection unit includes at least one form-fit connection element, which is movably supported on the guard unit and/or the hand-held power tool, thereby enabling the form-fit element to be moved and/or brought into an anti-rotation lock position if a tool should burst, and enabling an anti-rotation lock to be realized between the guard unit and the hand-held power tool via the form-fit connection unit. Removal may also be simplified by designing the form-fit connection unit to be movable out of the anti-rotation lock position so that it may be removed.

It is also provided that the form-fit connection unit is supported on the guard unit such that it is movable around a pivot axis, thereby making it possible to advantageously utilize a transfer of an impulse of an outwardly-slung piece of a burst tool, in order to attain an anti-rotation lock position of the form-fit connection element and/or the guard unit. The form-fit connection element is preferably deflected from its neutral position by an impulse of a tool piece that is transferred to the guard unit, and is moved into an anti-rotation lock position. This may be attained in a particularly advantageous manner when the form-fit connection element is located on a guard of the guard unit, in particular on a side of the guard that faces the tool when in the installed state.

In an advantageous refinement of the present invention, it is provided that the form-fit connection unit includes a guide element in which the form-fit connection element is movably supported, thereby making it possible to realize a particularly specific motion into an anti-rotation lock position, and to realize a low-wear motion of the form-fit connection element.

Additional components, installation space, assembly effort and costs may be advantageously saved when the form-fit connection element is designed at least partially as a single piece with the guard unit and/or the hand-held power tool. In this context, the term "single piece" is intended to mean, in particular, one piece, cast, and/or designed as one component.

If, in addition, the form-fit connection element is formed at least partially by a detent element, it is advantageously possible to prevent the guard unit from rotating, in particular if a tool should burst, and in particular when the detent element is provided to block a motion of the guard unit in at least one direction. A blocking direction of the detent element preferably refers to a direction of rotation of a tool.

In an advantageous refinement of the present invention, it is provided that the form-fit connection unit is movable—together with the guard unit—into an anti-rotation lock position, thereby making it possible to utilize energy from a piece of a burst tool that was transferred to the guard to change the position of the form-fit connection element to the anti-rotation lock position. An "anti-rotation lock position" refers, in particular, to a position of the guard unit relative to the hand-held power tool in which the guard unit is oriented opposite to a rotation, in particular a direction of rotation of the tool on the hand-held power tool, in particular on a receiving flange. This may be attained in a particularly advantageous manner when the form-fit connection element is provided to couple to the guard unit in an at least partially non-positive manner. A coupling may take place directly, or indirectly via a driving element and/or further components that appear reasonable to one skilled in the technical art.

It is also provided that the form-fit connection element includes at least one driving element, which is provided to drive at least one form-fit connection element into an anti-rotation lock position together with the guard unit, thereby making it possible to attain a deliberate change of position of the form-fit connection element into an anti-rotation lock position if a tool should burst.

It is possible to advantageously realize a driving of the form-fit connection element via the driving element into an anti-rotation lock position if a tool should burst when the driving element is provided to couple at least partially to the guard unit in a circumferential direction, the guard unit preferably undergoing a motion into an anti-rotation lock position along a direction of rotation of the tool due to a transfer of kinetic energy of an outwardly-slung piece of a burst tool. This may be attained using a simple design when the driving element is designed as an intermediate ring located between the guard unit and the hand-held power tool, and/or by a rolling element, and/or by further driving elements that appear reasonable to one skilled in the technical art.

It is furthermore provided that the form-fit connection unit includes at least one release-prevention mechanism, which is provided to fix at least one driving element and/or one form-fit element in a neutral position before an anti-rotation lock, thereby making it advantageously possible to prevent and/or block an installation procedure and/or a removal procedure of the guard unit using the form-fit connection element during installation or removal of the guard unit on the hand-held power tool. In this context, a "release-prevention mechanism" refers, in particular, to a securing of a form-fit element and/or a driving element that is provided to fix the form-fit element or the form-fit element together with the driving element in a neutral position during regular operation of the hand-held power tool system, and/or in a switched-off operating mode of the hand-held power tool, and, when a stronger force is applied, in particular by a piece of a tool that has burst during operation of the hand-held power tool and that strikes the guard unit, a motion of the form-fit connection element is released out of its neutral position and into an anti-rotation lock position.

An advantageous and, in particular, exact starting position of the form-fit element before an anti-rotation lock if a tool should burst may be advantageously attained when the form-fit connection unit includes at least one retaining element, which is provided to secure the form-fit connection element in a position in front of the anti-rotation lock. This may be attained in a manner with a particularly simple design when the retaining element is designed as a spring element.

In a further embodiment of the present invention, a hand-held power tool system is provided that includes a hand-held power tool, in particular an angle grinder, a guard unit, and a guard anti-rotation lock device, in which case the guard anti-rotation lock device includes a form-fit connection unit, which is provided to prevent the guard unit from rotating relative to the hand-held power tool if a tool should burst. As a result, it is possible to effectively protect an operator of the hand-held power tool from a tool that rotates during operation of the hand-held power tool, and/or, in particular, from pieces of the tool that are slung in the direction of the operator if the tool becomes damaged, e.g., if the tool should burst. To attain an anti-rotation lock of the guard unit on the hand-held power tool, the guard unit, which is attached to the hand-held power tool, may be moved into the anti-rotation lock position by absorbing forces of impulses and/or forces of outwardly-slung pieces of the burst tool.

It is furthermore provided that the hand-held power tool includes a receiving unit, which is provided at least partially to movably support the form-fit connection element, thereby making it possible to at least partially realize a particularly compact positioning of the form-fit connection unit.

It is also provided that the hand-held power tool includes a receiving unit with an intermediate ring on which the form-fit connection element is at least partially located, thereby making it possible to replace the form-fit connection element—using a simple design—if deformation should occur after a form-fit connection is established between the guard unit and the hand-held power tool if a tool should burst.

When the form-fit connection unit includes at least two form-fit connection elements, which are located one after the other in the circumferential direction on a receiving unit of the hand-held power tool and/or the guard unit, it is possible to realize a reusable form-fit and/or non-positive connection between the guard unit and the receiving unit, and/or the guard unit may be installed on the receiving unit in different positions along the circumferential direction in a non-rotating manner, in particular if a tool should burst. The term "circumferential direction" is intended to mean, in particular, a circumferential direction of the guard unit, which is oriented essentially parallel to a direction of rotation of the tool when the guard unit is in an installed state.

Particularly advantageously, the present invention includes a hand-held power tool for a rotating, preferably disk-shaped tool, with a machine housing that includes a flange and/or a machine neck, on which a guard—that is composed of sheet metal in particular—is detachably clampable in order to cover the tool. The guard includes a guard body, which is composed of a circular, disk-shaped piece, in particular with an outer edge located at a right angle thereto, and with a central, circular recess, on the edge of which a guard connection piece and/or collar is formed and that includes an annular clamping band that may be tightened using a clamping means. An anti-rotation lock that acts between the machine neck and the guard is located between the guard and the machine neck and is designed as a profiled structure. The guard may be repeatedly coupled via the clamping band and/or the clamping means in its clamping position in a form-fit and/or non-positive manner with the machine neck, and is therefore capable of being fixed in a non-rotatable position and, to attain a release position, may be disengaged from the form-fit and/or non-positive connection, so that the guard may then be adjusted in a rotational manner.

Further advantages result from the description of the drawing, below. Exemplary embodiments of the present invention are shown in the drawing. The drawing, the description, and the claims contain numerous features in combination. One skilled in the art will also advantageously consider the features individually and combine them to form further reasonable combinations.

DESCRIPTION OF THE PREFERRED EMBODIMENTS

Figure 1:
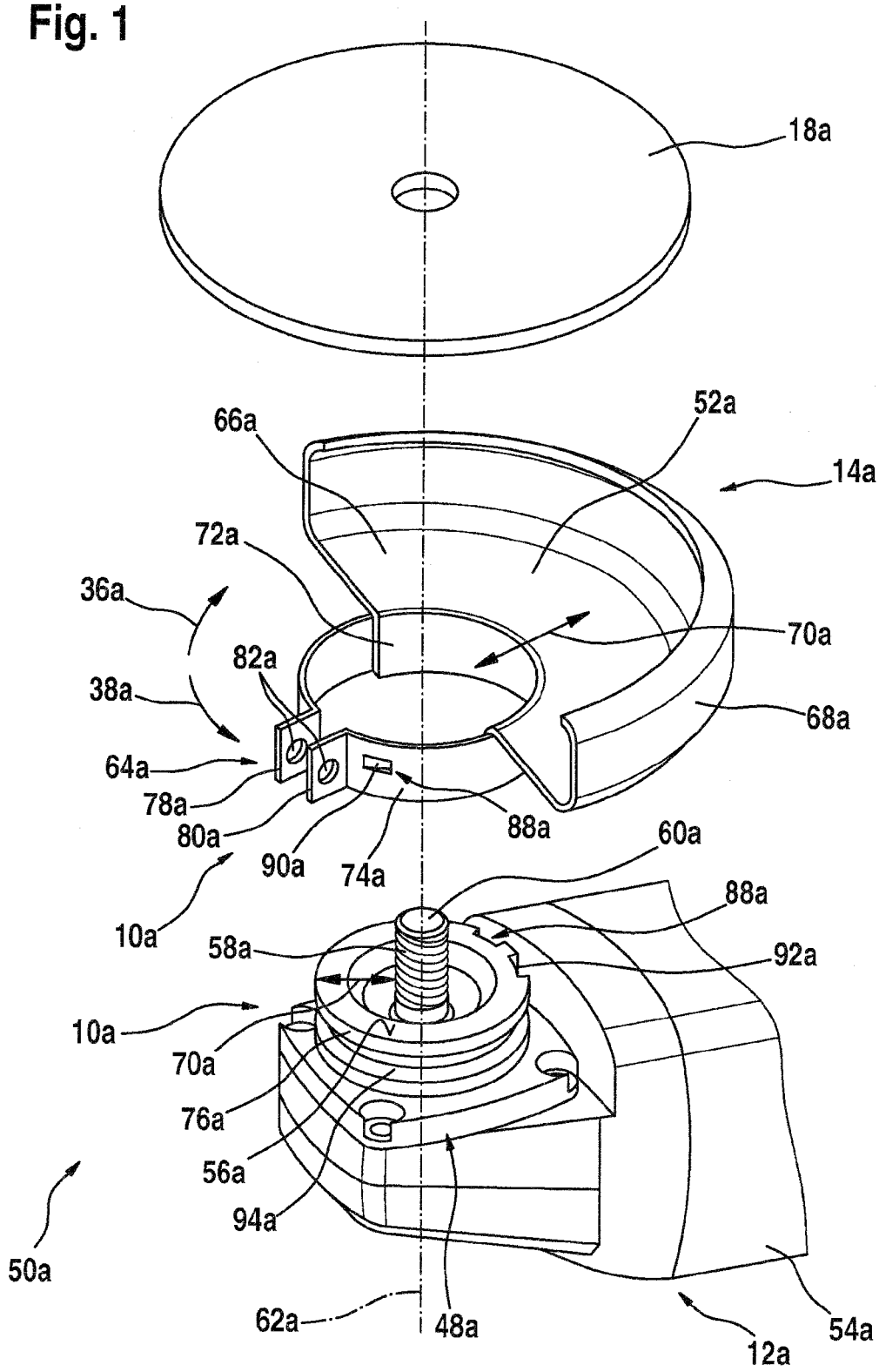
FIG. 1 shows an exploded view of an inventive hand-held power tool system.

FIG. 1 shows a hand-held power tool system 50*a* with a hand-held power tool 12*a* designed as an angle grinder and shown only partially here, and with a guard unit 14*a* and a guard anti-rotation lock device 10*a*. Hand-held power tool 12*a* includes a hand-held power tool housing 54*a*, and a receiving unit 48*a* for receiving guard unit 14 and/or a tool 18*a* designed as a cutting disk, receiving unit 24*a* being screwed together with hand-held power tool housing 54*a*. A drive shaft 58*a* extends out of receiving unit 48*a* on a side 56*a* facing away from hand-held power tool housing 54*a*. Drive shaft 50*a* is connectable at its free end 60*a* with disk-shaped tool 18*a* and is rotationally drivable around an axis 62*a*. Guard unit 14*a* includes a guard 52*a* and a closing unit 64*a*. When hand-held power tool system 50*a* is in an installed state, guard 52*a* extends around an angular range of tool 18*a* of approximately 180° and, to this end, includes a semi-disk shaped guard body 66*a* and a guard edge 68*a*, which is initially oriented perpendicularly to semi-disk shaped body 66*a* and is finally oriented parallel to semi-disk shaped guard body 66*a*, inwardly in a radial direction 70*a*.

Guard unit 52*a* also includes a guard collar 72*a*, which is oriented essentially perpendicularly to semi-disk shaped guard body 66*a*. Guard collar 72*a* is enclosed outwardly in radial direction 70*a* by a clamping band 74*a* of closing unit 64*a*. Guard collar 72*a* and clamping band 74*a* are interconnected via a welded connection. Guard collar 72*a*—together with clamping band 74*a*—is provided to attach guard unit 14*a* to hand-held power tool 12*a* and/or to receiving unit 48*a*, which includes a cylindrical receiving flange 76*a* for this purpose. Along a circumferential direction 36*a*, 38*a* of clamping band 74*a*, clamping band 28*a* includes two end regions 78*a*, 80*a* in a region that faces away from guard 52*a* and extends outwardly in radial direction 70*a*. End regions 78*a*, 80*a* each include a recess 82*a*, through which a closing element 84*a*—designed as a clamping screw—of closing unit 64*a* extends (see FIG. 2). The clamping screw may be fastened in recesses 82*a* of clamping band 74*a* using a nut 86*a*. Guard 52*a* is attached in a working position to receiving unit 48*a* and/or on receiving flange 76*a* via closing unit 64*a* using a frictional connection between guard collar 72*a* and clamping band 74*a* and receiving flange 76*a*, so that guard unit 14*a* is positioned in a non-rotatable manner during regular operation of hand-held power tool 12*a*. In an alternative design of closing unit 64*a*, it is basically feasible to use—instead of the clamping screw—further closing elements, e.g., a clamping lever and/or form-fit elements, etc.

Hand-held power tool system 50*a* also includes a coding device 88*a*, which is provided to prevent tools 18*a* and/or tools 18*a* together with guard unit 14*a* from being installed on unsuitable hand-held power tools 12*a*. To this end, clamping band 74*a* includes a coding element 90*a* of coding device 88*a*, which is designed as a single piece with clamping band 74*a*. Coding element 90*a* is designed as a pressed-out region that extends inwardly in radial direction 70*a* and has a rectangular shape. Correspondingly, receiving flange 76*a* includes a coding element 92*a* of coding device 88*a*, which is designed as a recess into which coding element 90*a* of clamping band 74*a* may be inserted when guard unit 14*a* is installed on hand-held power tool 12*a*. After guard unit 14*a* has been inserted onto receiving unit 48*a*, guard unit 14*a* may be rotated into a working position. To this end, receiving flange 76*a* includes a groove 94*a* that extends in circumferential direction 36*a*, 38*a*, in which coding element 90*a* is guided when guard unit 14*a* is rotated into the working position.

Figure 2:
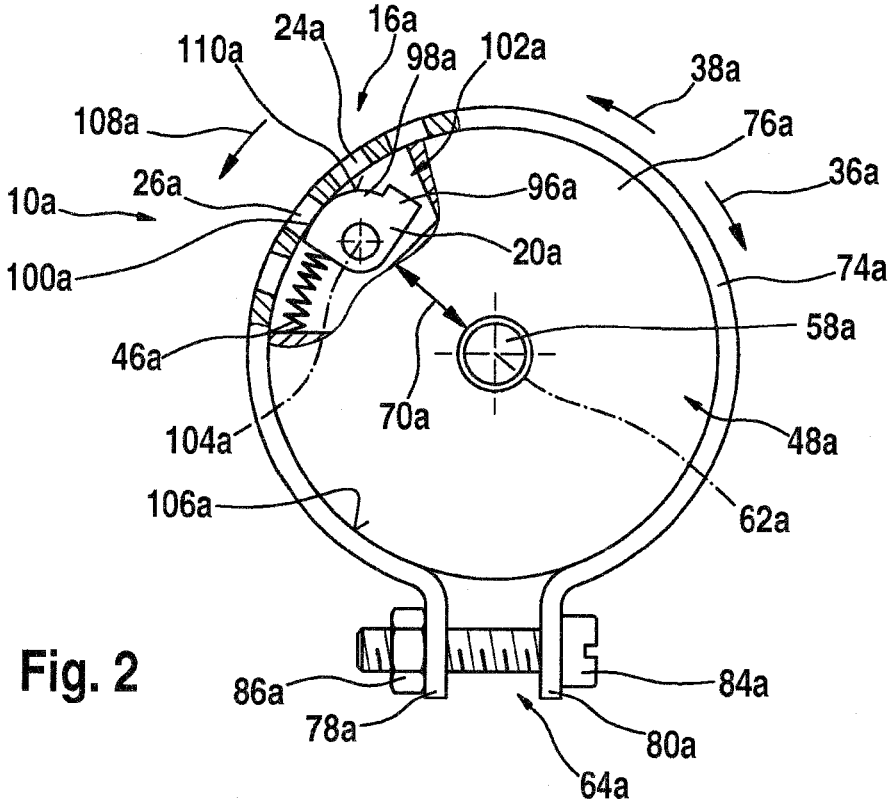
FIG. 2 shows a guard anti-rotation lock device with a form-fit connection element, in a schematic, partial cross-sectional view.

FIG. 2 shows guard anti-rotation lock device 10*a* in FIG. 1 in greater detail. Guard anti-rotation lock device 10*a* is provided to prevent rotation between guard unit 14*a* and hand-held power tool 12*a* and/or receiving unit 48*a* during a breakdown of tool 18*a*, e.g., when a tool 18*a* bursts. To this end, anti-rotation lock device 10*a* includes a form-fit connection unit 16*a*, which is provided to prevent rotation in a form-fit manner between hand-held power tool 12*a* and guard unit 14*a* if a tool 18*a* should burst. Form-fit connection unit 16*a* includes a form-fit connection element 20*a*, which is located inside receiving flange 76*a*, and several form-fit connection elements 24*a*, 26*a*, which are located one after the other in circumferential direction 36*a*, 38*a* on clamping band 74*a* and/or guard collar 72*a* of guard unit 14*a*. Form-fit connecting elements 24*a*, 26*a* of guard unit 14*a* are designed as recesses.

Form-fit connecting element 20*a* of receiving flange 76*a* includes a hook element 96*a* and a subregion 98*a*, which is designed as a rolling element 100*a*. In addition, form-fit connection element 20*a* is located on an edge region 102—located outwardly in radial direction 70*a*—of receiving flange 76*a* such that it may rotate around rotation axis 104*a*. When guard unit 14*a* is in a working position, subregion 98*a* of form-fit connection element 20*a* designed as rolling element 100*a* bears against a surface 106*a*—that faces inwardly in radial direction 70*a*—of clamping band 74*a* and/or guard collar 72*a*. Form-fit connection element 20*a* couples in a non-positive manner to clamping band 74*a* and/or guard collar 72*a*. Form-fit connection element 16*a* also includes a retaining element 46*a*, which is designed as a spring element and holds form-fit connection element 20*a* in a position before an anti-rotation lock. It is also feasible for form-fit connection element 20*a* to be located—due to its design in radial direction 70*a*—in receiving unit 48*a* in a form-fit manner.

If a tool 18*a* should burst during operation of hand-held power tool 12*a*, tool pieces are slung outwardly in a rotation direction 108*a* of tool 18*a*. If one of these tool pieces strikes guard unit 14*a*, the kinetic energy of the tool piece transferred to guard unit 14*a* exceeds the attachment energy of the frictional connection of closing unit 64*a* between guard unit 14*a* and hand-held power tool 12*a*. Guard unit 14*a* is then rotated out of its working position and in rotation direction 108*a* of tool 18*a*. Form-fit connection element 20*a*, which couples on surface 106*a*—which faces inward in radial direction 70*a*—of clamping band 74*a* and/or guard collar 72*a* in a non-positive manner, is rotated around rotation axis 104*a* in rotation direction 108*a*. Due to a motion of guard unit 14*a*, form-fit connection element 20*a* and/or subregion 98*a* of form-fit connection unit 20*a* designed as rolling element 100*a* walk(s) around clamping band 74*a* and/or guard collar 72*a*, so that form-fit connection element 20*a* is moved together with guard unit 14*a*. In addition, it is also feasible for surface 106*a*—which faces inward in radial direction 70*a*—of clamping band 74*a* and/or guard collar 72*a*, and/or an outer surface 110*a* of subregion 98*a* designed as rolling element 100*a* to have a high friction coefficient in order to increase a non-positive connection between form-fit connection element 20*a* and clamping band 74*a* and/or guard collar 72*a* due to a special material selection and/or a special surface treatment.

Due to the rotation of form-fit connection element 20*a*, hook element 96*a* is rotated outwardly, and thereby extends through one of the recesses in clamping band 74*a* and/or guard collar 72*a*. As soon as a form-fit connection is established between form-fit connection element 20*a* supported in receiving unit 48*a* and one of the form-fit connection elements 24*a*, 26*a* of clamping band 74*a* and/or guard collar 72*a*, guard unit 14*a* is located in an anti-rotation lock position relative to hand-held power tool 12*a*. In a further embodiment of the present invention, it is feasible to increase the number of form-fit connection elements 20*a*, 24*a*, 26*a* and/or to change a location of form-fit connection element 20*a* within receiving unit 48*a* in a manner that appears reasonable to one skilled in the technical art.

Alternative exemplary embodiments are shown in FIGS. 3 through 12*b*. Components, features, and functions that are essentially the same are labelled with the same reference numerals. To distinguish the exemplary embodiments from each other, the reference numerals of the exemplary embodiments are appended with the letters a through k. The description below is essentially limited to the differences from the exemplary embodiment in FIGS. 1 and 2. With regard for the components, features, and functions that remain the same, reference is made to the description of the exemplary embodiment in FIGS. 1 and 2.

Figure 3:
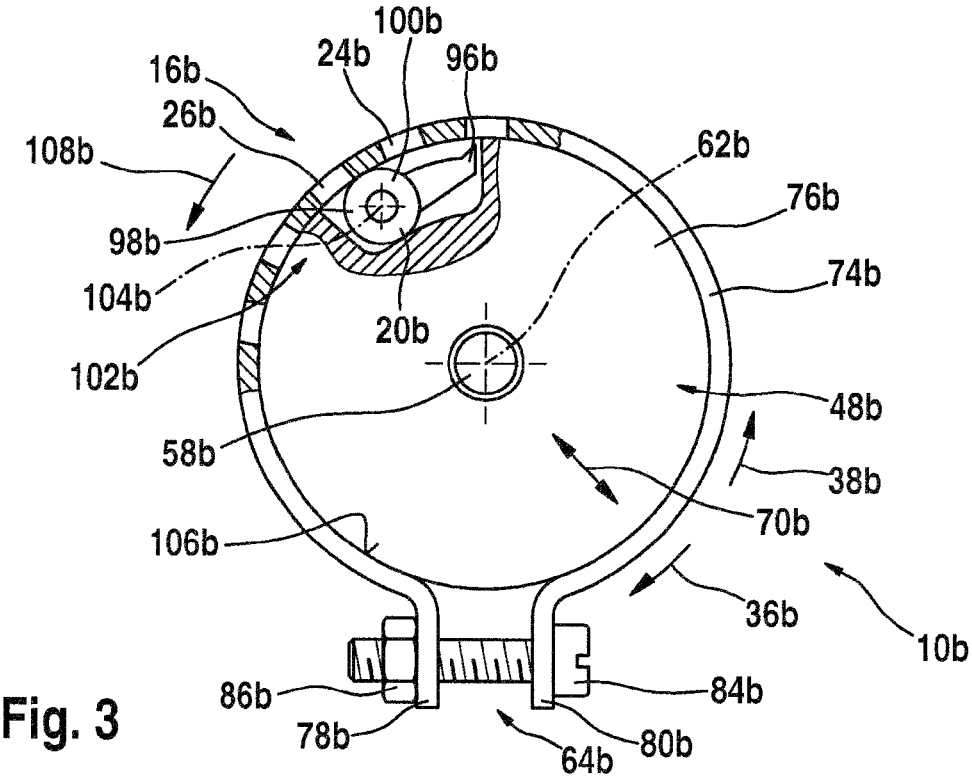
FIG. 3 shows a guard anti-rotation lock device with a form-fit connection element that is an alternative to that shown in FIG. 2, in a schematic, partial cross-sectional view.

FIG. 3 shows an alternative embodiment of guard anti-rotation lock device 10*b* Guard anti-rotation lock device 10*b* includes a form-fit connection unit 16*b*, which is provided to prevent rotation between a guard unit and a receiving unit 48*b* of a hand-held power tool if a tool should burst. Form-fit connection unit 16*b* includes a form-fit connection element 20*b*, which is rotatably supported inside receiving unit 48*b*. Form-fit connection element 20*b* differs from the embodiments shown in FIG. 2 in that a hook element 96*b* for establishing a form-fit connection between the hand-held power tool and the guard unit is reinforced in this case, thereby resulting in earlier engagement in a form-fit connection element 24*b*, 26*b* of the guard unit. A further embodiment of form-fit connection unit 16*b* and/or the guard anti-rotation lock device, and a mode of operation of guard anti-rotation lock device 10*b* are similar to those described with reference to FIG. 2.

Figure 4:
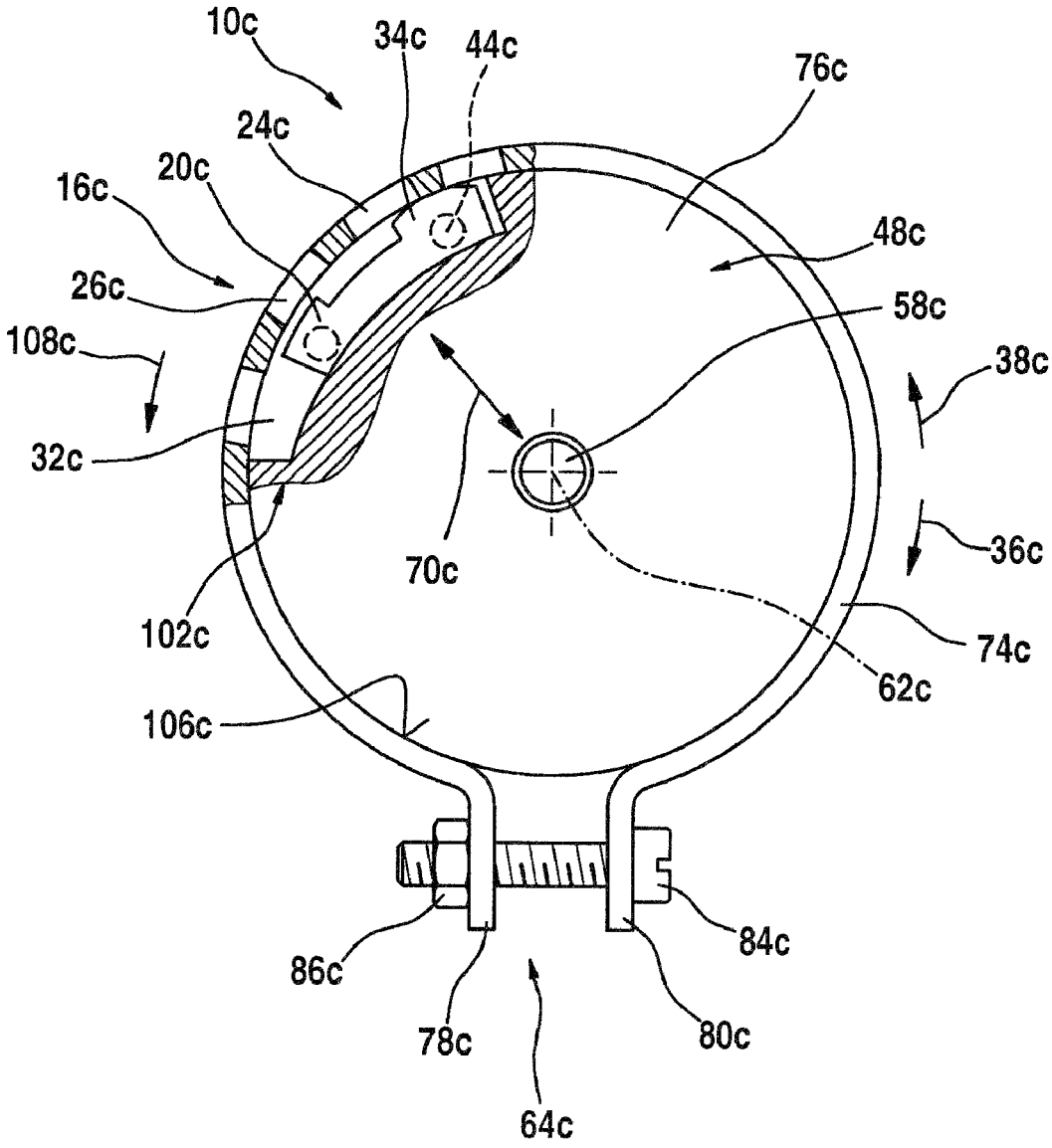
FIG. 4 shows a guard anti-rotation lock device with a form-fit connection element that is movably supported in a guide element, in a schematic, partial cross-sectional view.

FIG. 4 shows an alternative embodiment of guard anti-rotation lock device 10*c*. Guard anti-rotation lock device 10*c* includes a form-fit connection unit 16*c*, which is provided to prevent rotation between a guard unit and a receiving unit 48*c* of a hand-held power tool if a tool should burst. Form-fit connection unit 16*c* includes a form-fit connection element 20*c* that is movably supported in receiving unit 48*c*, and several form-fit connection elements 24*c*, 26*c* located one after the other in a circumferential direction 36*c*, 38*c*. Form-fit connection element 20*c* of receiving unit 48*c* is designed as a single piece with driving element 34*c*. Form-fit connection element 20*c* in located in a rotation direction 108*c* of a tool, downstream of driving element 34*c*. Driving element 34*c*—together with form-fit connection element 20*c*—is also fixed in a neutral position—before an anti-rotation lock is implemented—relative to receiving unit 48*c* via a release-prevention mechanism 44*c*, only a portion of which is shown. Driving element 34*c* couples in a non-positive manner to a clamping band 74*c* and/or a guard collar of guard unit if the guard unit should rotate when in an installed state. In addition, receiving unit 48*c* includes a guide element 32*c*—which is tapered in rotation direction 108*c*—of form-fit connection unit 16*c*, in which form-fit connection element 20*c* is movably supported. Guide element 32*c* is designed as a guide groove and is located in an outer—in radial direction 70*c*—edge region 102*c* of a receiving flange 76*c*. If a tool should burst, the guard unit is rotated out of its working position and in rotation direction 108*c*. An impulse of the guard unit in rotation direction 108*c* is greater than a force of release-prevention mechanism 44*c*, thereby enabling form-fit connection element 20*c* to be moved together with driving element 34*c* and the guard unit, also in rotation direction 108*c*. Due to the tapered design of guide element 32*c*, form-fit connection element 20*c* is also moved outwardly in radial direction 70*c* and engages in one of the form-fit connection elements 24*c*, 26*c* of the guard unit.

Figure 5:
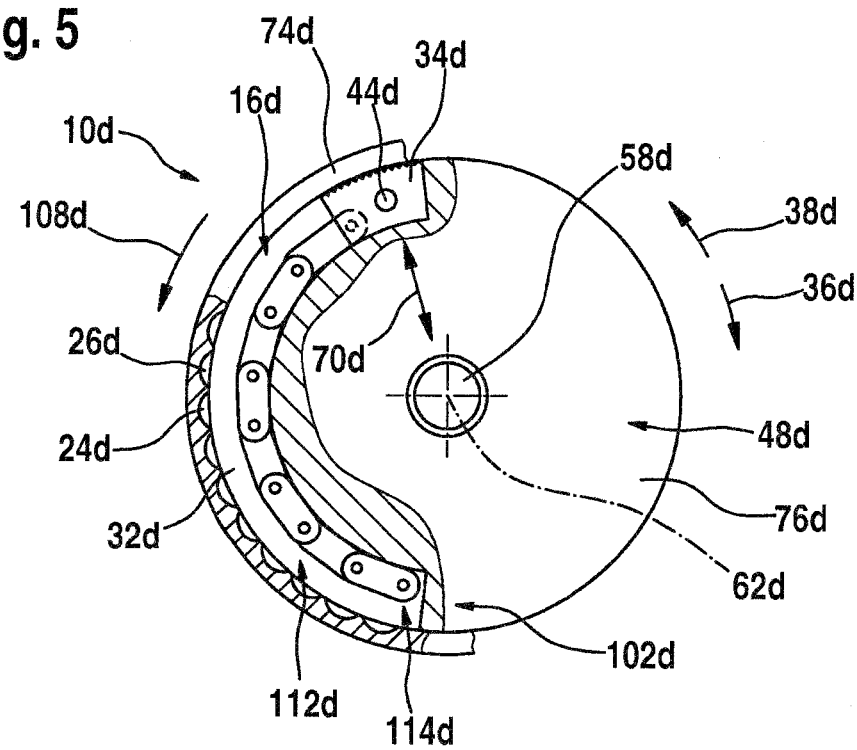
FIG. 5 shows a guard anti-rotation lock device with a form-fit connection element designed as a chain, in a schematic, partial cross-sectional view.

FIG. 5 shows an alternative embodiment of guard anti-rotation lock device 10*d*. Guard anti-rotation lock device 10*d* includes a form-fit connection unit 16*d*, which is provided to prevent rotation between a guard unit and a receiving unit 48*d* of a hand-held power tool if a tool should burst. Form-fit connection unit 16*d* includes several form-fit connection elements 24*d*, 26*d*, which are located one after the other in a circumferential direction 36*d*, 38*d*, each of which is formed by a recess that extends outwardly in a radial direction 70*d* and is located on a clamping band 74*d* and/or a guard collar of the guard unit. Moreover, receiving unit 48*d* includes a further form-fit connection element 20*d* of form-fit connection unit 16*d*, which is movably supported in a guide element 32*d*—designed as a guide groove—of receiving unit 48*d*. The guide groove is located in an outer—in radial direction 70*d*—edge region 102*d* of a receiving flange 76*d*. Form-fit connection element 20*d* is designed as a chain and is fixedly located on a driving element 34*d* designed as a sliding carriage. Driving element 34*d* is fixed in a neutral position—before an anti-rotation lock is implemented—relative to receiving unit 48*d* via a release-prevention mechanism 44*d*, only a portion of which is shown. Moreover, a link of the chain is fixed in position in an end region 114*d* facing away from driving element 34*d*, so that the chain—together with driving element 34*d*—extends along circumferential direction 36*d*, 38*d* along the entire length of the guide groove. If a tool should burst, driving element 34*d* couples in a non-positive manner to clamping band 74*d* and/or the guard collar, and is moved—together with the guard unit—when rotation occurs in rotation direction 108*d* due to a piece of a burst tool striking the guard unit, as described with reference to FIG. 4. As a result, a region 112*d* that is present within the guide groove of the chain is reduced along rotation direction 108*d*, so that individual links in the chain move toward each other and thereby fold up relative to each other. Individual links engage in form-fit connection elements 24*d*, 26*d*—designed as recesses—of the guard unit and bring about an anti-rotation lock of the guard unit.

Figure 6:
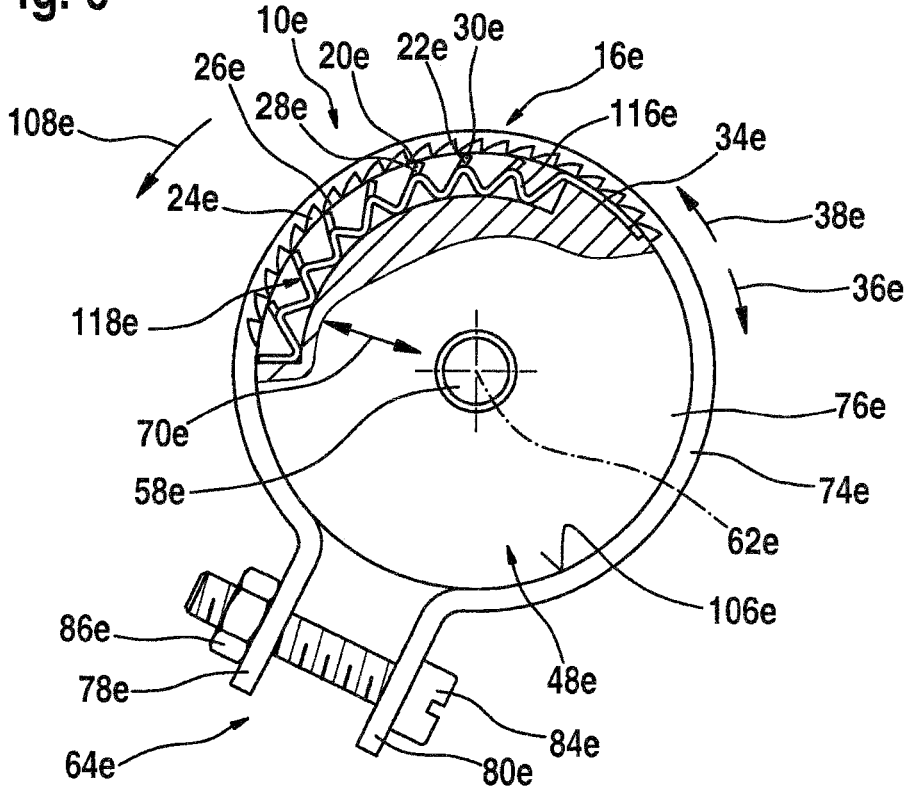
FIG. 6 shows a guard anti-rotation lock device with a folded form-fit connection element, in a schematic, partial cross-sectional view.

FIG. 6 shows an alternative embodiment of guard anti-rotation lock device 10*e*. Guard anti-rotation lock device 10*e* includes a form-fit connection unit 16*e*, which is provided to prevent rotation between a guard unit and a receiving unit 48*e* of a hand-held power tool if a tool should burst. Form-fit connection unit 16*e* includes several form-fit connection elements 24*e*, 26*e*, which are located one after the other in a circumferential direction 36*e*, 38*e*, each of which is formed by a detent recess and is located on a clamping band 74*e* and/or a guard collar of the guard unit. The detent recesses include a detent bevel, which extends outwardly away from a surface 106*e*—which faces inwardly, in radial direction 70*e*—of clamping band 74*e* and/or the guard collar, and opposite to a rotation direction 108*e* of a tool. Receiving unit 48*e* also includes several form-fit connection elements 20*e*, 22*e* located one after the other in circumferential direction 36*e*, 38*e*, each of which is designed as a detent element 28*e*, 30*e*. Detent elements 28*e*, 30*e* are designed as single pieces with a folded sheet-metal element 116*e*, and they are located in an outer—in radial direction 70*e*—fold region 118*e* of sheet-metal element 116*e*. Sheet-metal element 116*e* includes a driving element 34*e* and fold region 118*e*, and extends along circumferential direction 36*e*, 38*e* over an entire length of a guide element 32*e* of receiving unit 48*e*. Moreover, detent elements 28*e*, 30*e* extend diagonally in radial direction 70*e*, outwardly and opposite to rotation direction 108*e*, so that they may engage in the detent recesses in a form-fit manner and block a motion of the guard unit relative to the hand-held power tool in rotation direction 108*e* if a tool should burst. An anti-rotation lock brought about using form-fit connection elements 20*e*, 22*e*, 24*e*, 26*e* and driving element 34*e* if a tool should burst takes place as described with reference to FIG. 5.

Figure 7:
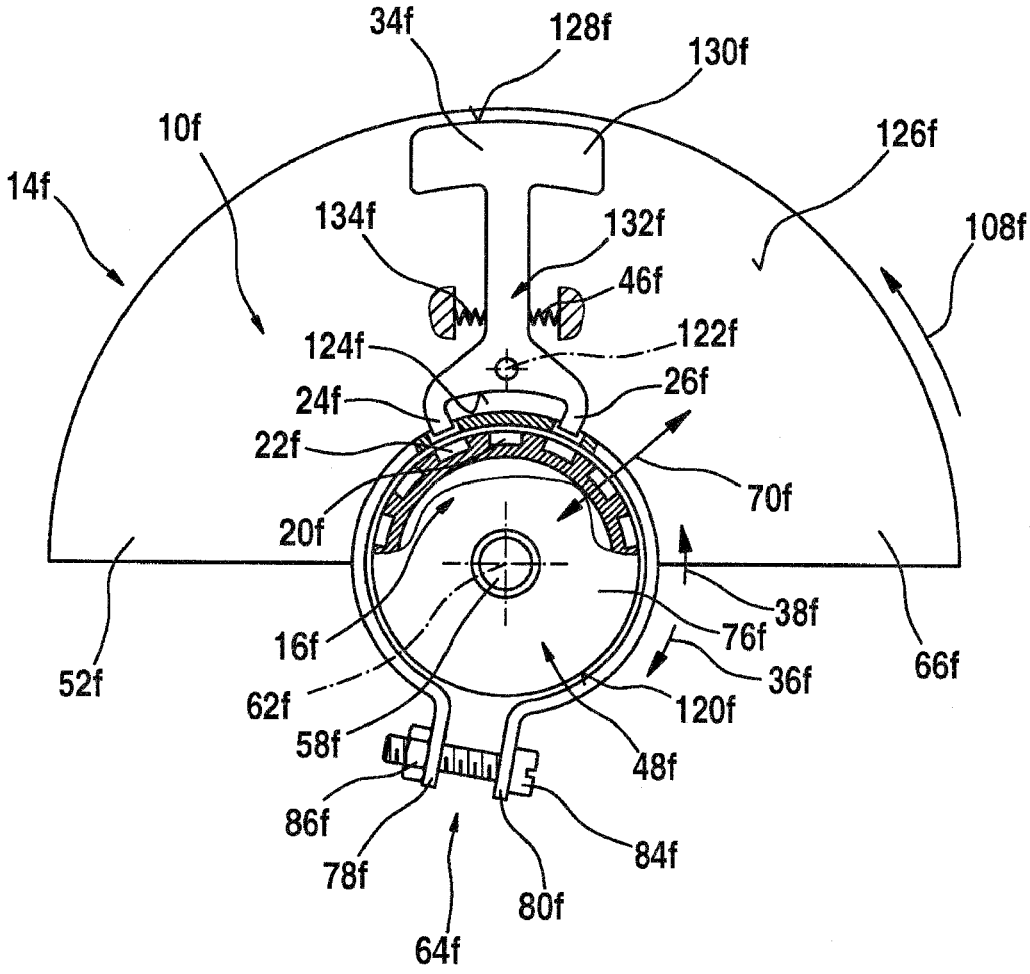
FIG. 7 shows a guard anti-rotation lock device with a pivotably supported form-fit connection element, in a schematic, partial cross-sectional view.

FIG. 7 shows an alternative embodiment of guard anti-rotation lock device 10*f*. Guard anti-rotation lock device 10*f* includes a form-fit connection unit 16*f*, which is provided to prevent rotation between a guard unit and a receiving unit 48*f* of a hand-held power tool if a tool should burst. Form-fit connection unit 16*f* includes several form-fit connection elements 20*f*, 22*f*, which are located one after the other in a circumferential direction 36*f*, 38*f*, and each of which is formed by a recess and extends inwardly in a radial direction 70*f* away from an outwardly oriented surface 120*f* of a receiving flange 76*f* of receiving unit 48*f*. In addition, form-fit connection element 16*f* includes two further form-fit connection elements 24*f*, 26*f*, which are designed as single pieces with a driving element 34*f*—which is designed as an oscillating element—and which are supported together with driving element 34*f* on guard unit 14*f* such that they may oscillate around a pivot axis 122*f*. Form-fit connection elements 24*f*, 26*f* are located on a radially inwardly facing side 124*f* of the oscillating element, which—in an installed state of the hand-held power tool system—is located on a surface 126*f*—which faces a tool—of a guard body 66*f*. Form-fit connection elements 24*f*, 26*f* extend inwardly in radial direction 70*f*, away from the oscillating element. The oscillating element includes—on a side 128*f* facing away from form-fit connection elements 24, 26*f*—an oscillating weight 130*f*, and is secured in a position—before an anti-rotation lock is implemented—in a central subregion 132*f* via two retaining elements 46*f*, 134*f* designed as spring elements. When guard unit 14*f* is struck by an outwardly-slung tool piece when a tool bursts, guard unit 14*f* is affected by an impulse in a rotation direction 108*f* of the tool. The oscillating element is deflected out of its neutral position, and one of the two form-fit connection elements 24*f*, 26*f* engages in one of the recesses in receiving unit 48*f*, thereby preventing guard unit 14*f* from rotating further.

Figure 8A:
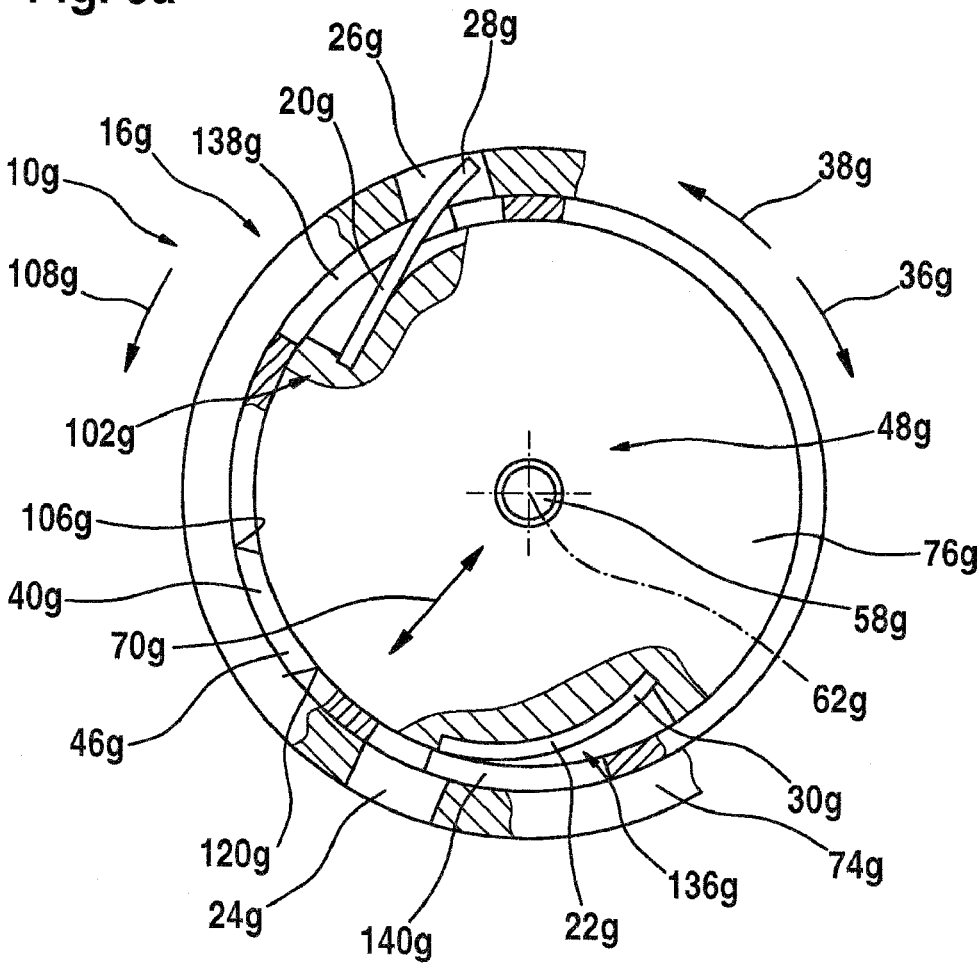
FIGS. 8*a* and 8*b* show a guard anti-rotation lock unit with an intermediate ring and a form-fit connection element, in a schematic side view (FIG. 8*a*), and in a perspective view (FIG. 8*b*)
Figure 8B:
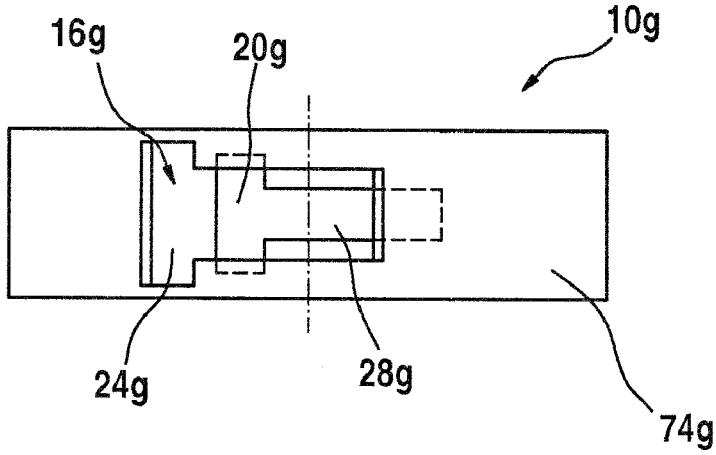

An alternative design of a guard anti-rotation lock 10*g* is shown in FIGS. 8*a* and 8*b*. Guard anti-rotation lock device 10*g* includes a form-fit connection unit 16*g*, which is provided to prevent rotation between a guard unit and a receiving unit 48*g* of a hand-held power tool if a tool should burst. Form-fit connection unit 16*g* includes two form-fit connection elements 20*g*, 22*g*, each of which is formed by a detent element 28*g*, 30*g*, and which are movably located within receiving unit 48*g* on edge regions 102*g*, 136*g* which are diametrically opposed in circumferential direction 36*g*, 38*g*. Detent elements 28*g*, 30*g* are designed as spring elements, and, in a neutral position before an anti-rotation lock is implemented, are located inside receiving unit 48*g* and are preloaded against a spring force. To this end, receiving unit 48*g* includes an intermediate ring 40*g* designed as a retaining element 46*g*, which is rotatably located on a radially outwardly oriented surface 120*g* of a receiving flange 76*g*. Intermediate ring 40*g* is secured via a not-shown release-prevention mechanism from accidentally rotating on receiving flange 76*g*. Further form-fit connection elements 24*g*, 26*g* are located on a clamping band 74*g* and/or a guard collar, and they are designed as recesses. Intermediate ring 40*g* couples in a non-positive manner to clamping band 74*g* and/or the guard collar, so that, if a tool should burst, it releases an anti-rotation lock position of form-fit connection elements 20*g*, 22*g*. To this end, intermediate ring 40*g* also includes recesses 138*g*, 140*g*, via which detent elements 28*g*, 30*g* extend into the recesses in clamping band 74*g* and/or the guard collar.

Figure 9:
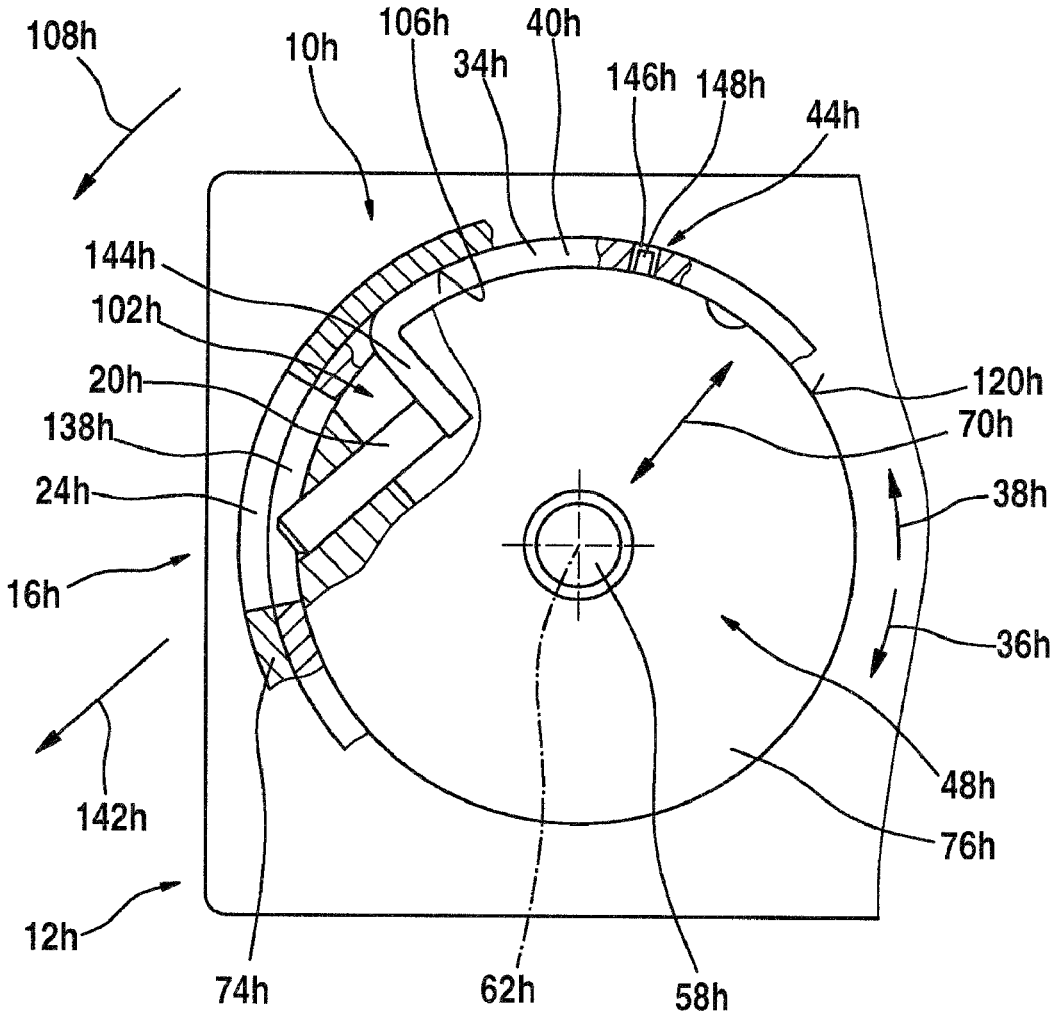
FIG. 9 shows a guard anti-rotation lock device with a driving element designed as an intermediate ring, in a schematic, partial cross-sectional view.

FIG. 9 shows an alternative embodiment of guard anti-rotation lock device 10*h*. Guard anti-rotation lock device 10*h* includes a form-fit connection unit 16*h*, which is provided to prevent rotation between a guard unit and a receiving unit 48*h* of a hand-held power tool 12*h* if a tool should burst. Form-fit connection unit 16*h* includes a form-fit connection element 20*h*, which is movably supported inside receiving unit 48*h* and is designed as a bolt. Form-fit connection element 20*h* is movable in an outward direction into an anti-rotation lock position of receiving unit 48*h* via a driving element 34*h*, which is designed as an intermediate ring 40*h*. A moving direction 142*h* of form-fit connection element 20*h* extends diagonally to radial direction 70*h* in a rotation direction 108*h* of the tool. A maximum angle of inclination of form-fit connection element 20*h* relative to radial direction 70*h* is 45°. To this end, intermediate ring 40*h* includes a peg-shaped element 144*h* that is bent inwardly in radial direction 70*h*, which moves form-fit connection element 20*h* into an anti-rotation lock position when intermediate ring 40*h* rotates in rotation direction 108*h*. Intermediate ring 40*h* is also held in a neutral position—before an anti-rotation lock is implemented—relative to receiving unit 48*h* via a release-prevention mechanism 44*h*. Release-prevention mechanism 44*h* includes a securing element 146*h*—which is designed as a recess—on intermediate ring 40*h*, in which a securing element 148*h*—designed as a raised area—of receiving unit 48*h* is supported. Intermediate ring 40*h* is driven via a motion of the guard unit into an anti-rotation lock position in the manner described with reference to FIG. 8, and an anti-rotation lock with the guard unit is implemented via form-fit connection element 20*h* in a manner described with reference to FIG. 2.

Figure 10:
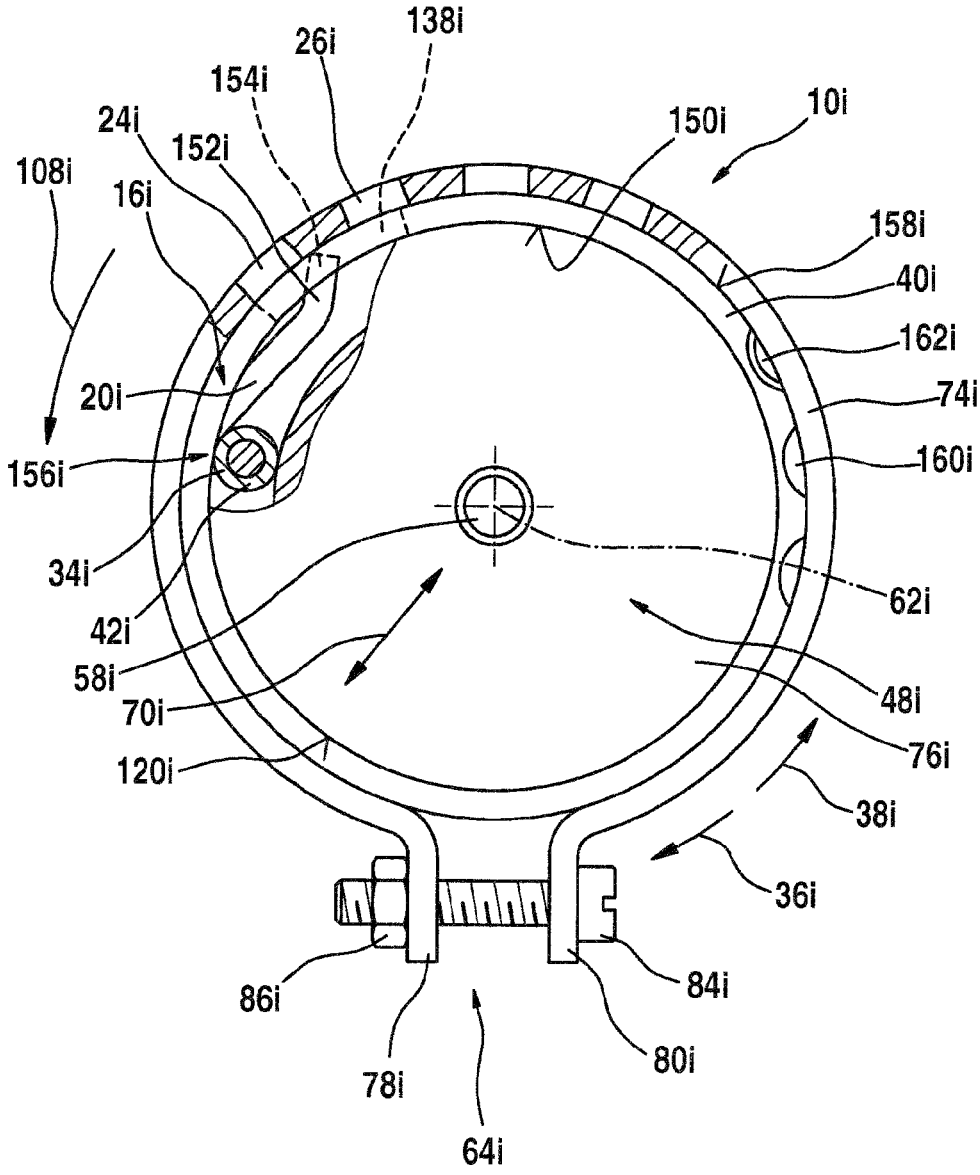
FIG. 10 shows a guard anti-rotation lock device with a form-fit connection element designed as a single piece with an intermediate ring, in a schematic, partial cross-sectional view.

FIG. 10 shows an alternative embodiment of guard anti-rotation lock device 10*i*. Guard anti-rotation lock device 10*i* includes a form-fit connection unit 16*i*, which is provided to prevent rotation between a guard unit and a receiving unit 48*i* of a hand-held power tool if a tool should burst. Form-fit connection unit 16*i* includes a form-fit connection element 20*i*, which is designed as a single piece with an intermediate ring 40*i* of receiving unit 48*i*. Form-fit connection element 20*i* is designed as a tab, which projects outwardly from a side 150*i*—which faces inwardly in radial direction 70*i*—of intermediate ring 40*i*, and which extends away from intermediate ring 40*i* opposite to a rotation direction 108*i* of a tool. On an end 152*i* facing away from intermediate ring 40*i*, the tab includes a hook element 154*i*, which is designed as a single piece with the tab. Hook element 154*i* extends diagonally outward. Furthermore, form-fit connection unit 16*i* includes a driving element 34*i*, which is designed as a rolling element 42*i* that is rotatable in circumferential direction 36*i*, 38*i*, and which is located inside receiving unit 48*i* on inwardly-facing side 150*i* of intermediate ring 40*i*. Rolling element 42*i* bears along circumferential direction 36*i*, 38*i* in a region 156*i* of intermediate ring 40*i*, on which form-fit connection element 20*i* is located. Intermediate ring 40*i* couples in a form-fit manner with a clamping band 74*i* and/or a guard collar of the guard unit. To this end, intermediate ring 40*i* includes—on a surface 158*i* that faces outward in radial direction 70*i*—several coupling elements 160*i* designed as notches. Correspondingly, clamping band 74*i* and/or the guard collar include(s) a coupling element 162*i* that is designed as a raised area that extends inwardly in radial direction 70*i*. When the guard unit is in an installed working position on the hand-held power tool, coupling elements 160*i*, 162*i* engage in each other in a form-fit manner. If the guard unit is struck by an outwardly-slung tool piece when a tool bursts, and the guard unit is moved together with intermediate ring 40*i* in rotation direction 108*i*, rolling element 42*i* walks around intermediate ring 40*i* and the tab is pressed outwardly in radial direction 70*i* and extends through a recess 138*i* in intermediate ring 40*i* in one of several form-fit connection elements 24*i*, 26*i* which are designed as recesses in the guard unit.

Figure 11A:
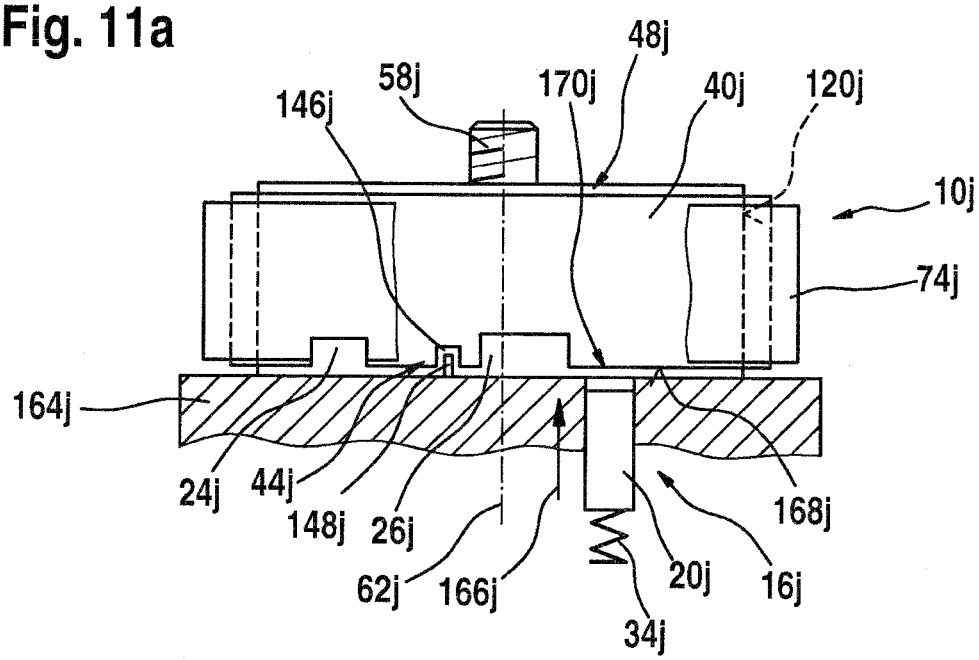
FIGS. 11*a* and 11*b* show a guard anti-rotation lock unit with a form-fit connection element that is movable perpendicularly to a direction of rotation, in a first schematic, partial cross-sectional view (FIG. 11*a*), and in a second, schematic partial cross-sectional view (FIG. 11*b*)
Figure 11B:
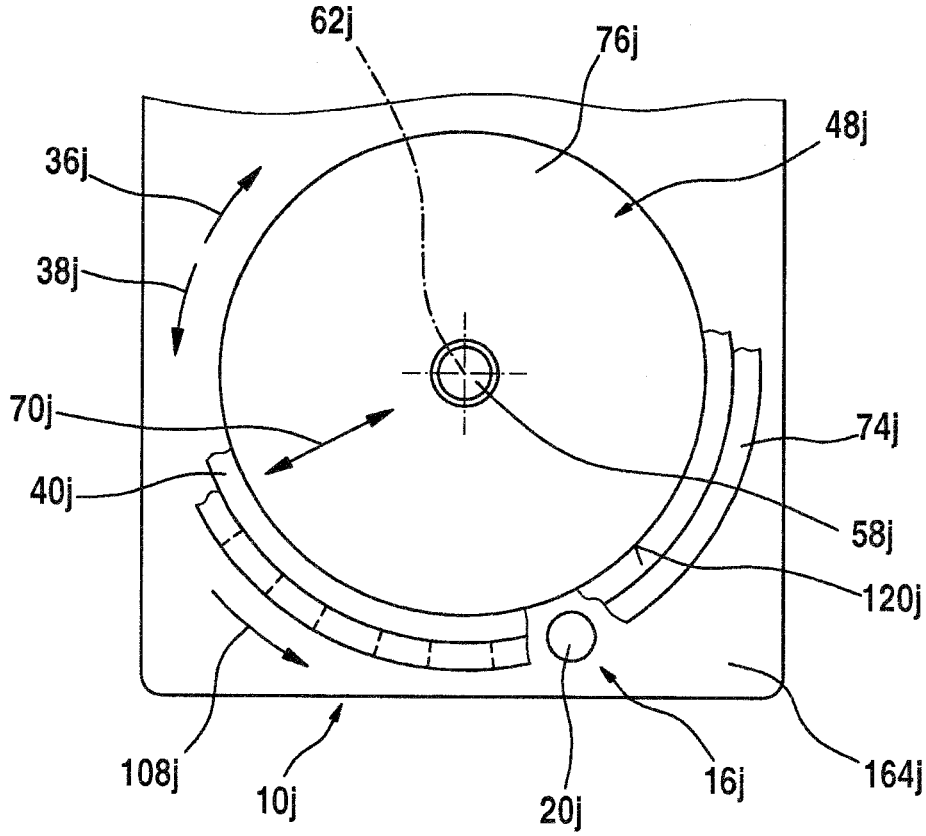

An alternative design of a guard anti-rotation lock 10*j* is shown in FIGS. 11*a* and 11*b*. Guard anti-rotation lock device 10*j* includes a form-fit connection unit 16*j*, which is provided to prevent rotation between a guard unit and a receiving unit 48*j* of a hand-held power tool if a tool should burst. Receiving unit 48*j* includes a form-fit connection element 20*j* of form-fit connection unit 16*j*, which is designed as a bolt and is located inside a main element 164*j* of receiving flange 76*j*. The bolt is supported such that it is movable along a direction 166*j* away from main element 164*j* in the direction of a free end of a drive shaft 58*j* in main element 164*j*. In addition, receiving unit 48*j* includes an intermediate ring 40*j*, which is located in circumferential direction 36*j*, 38*j* around a receiving flange 76*j*, and is fixed in a neutral position—before an anti-rotation lock is implemented—on receiving flange 76*j* via a release-prevention mechanism 44*h*, which is designed as described with reference to FIG. 9. A clamping band 74*j* and/or a guard collar of the guard unit are located around intermediate ring 40*j* in a non-positive manner. Intermediate ring 40*j* and clamping band 74*j* and/or the guard collar include form-fit connection elements 24*j*, 26*j* of form-fit connection unit 16*j*—designed as recesses—on a side 168*j* facing main element 164*j*. When the guard unit is in an installed working position, the bolt is supported by a recess-free subregion 170*j* of clamping band 74*j* and/or the guard collar together with intermediate ring 40*j* in main element 164*j* against a spring force of a driving element 34*j*, which is designed as a spring element. When the guard unit is rotated out of its working position together with intermediate ring 40*j*, as is the case when a tool bursts, recess-free subregion 170*j* is rotated away from the bolt, and the bolt moves due to spring force in direction 166*j* and engages in one of the form-fit connection elements 24*j*, 26*j*, thereby halting a rotation between the guard unit and the hand-held power tool.

Figure 12:
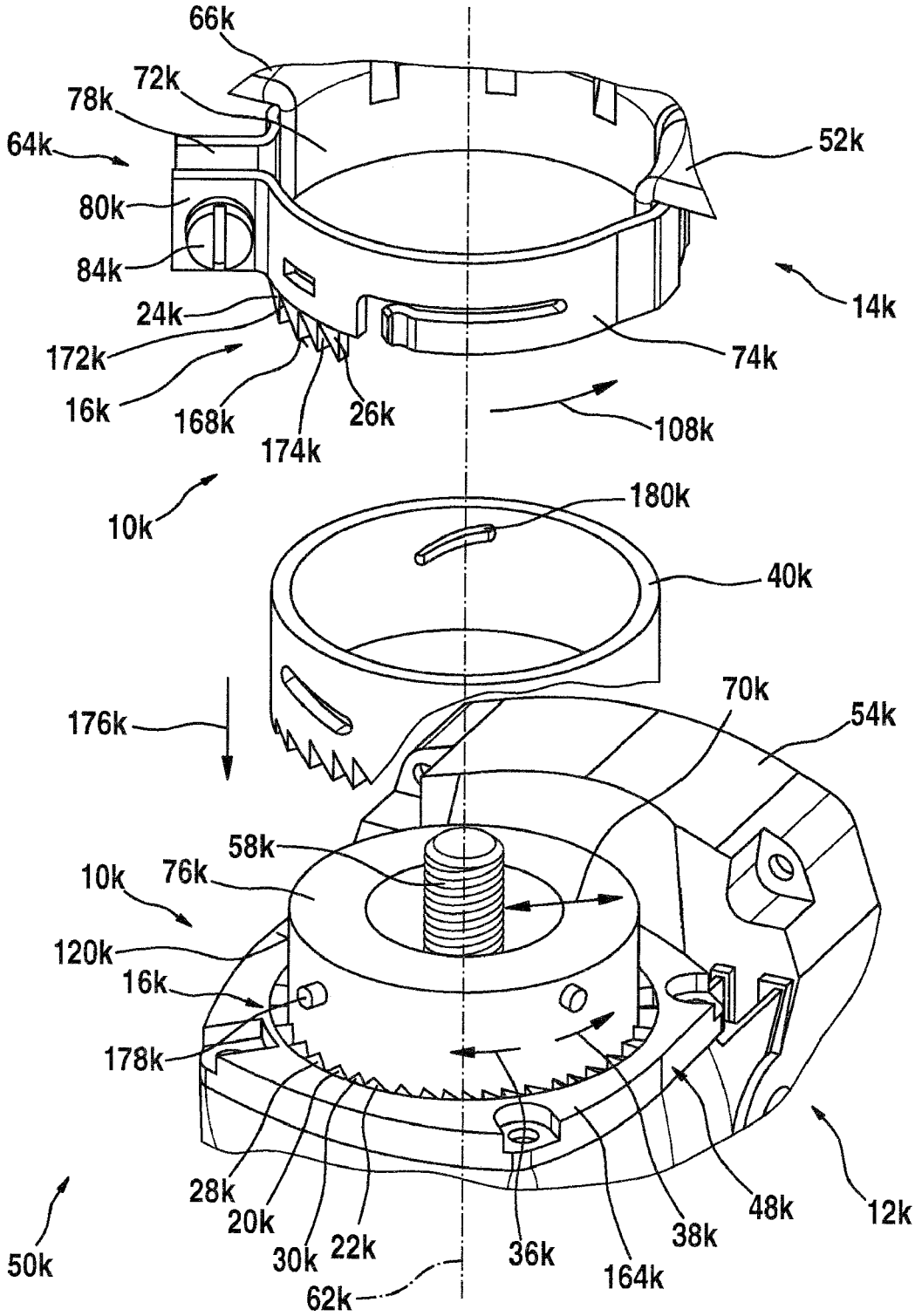
FIG. 12 shows a guard anti-rotation lock device with a form-fit connection element designed as a single piece with a receiving unit, in an exploded view.

FIG. 12 shows an alternative embodiment of guard anti-rotation lock device 10*k* of a hand-held power tool system 50*k*. Guard anti-rotation lock device 10*k* includes a form-fit connection unit 16*k*, which is provided to prevent rotation between a guard unit 14*k* and a receiving unit 48*k* of a hand-held power tool 12*k* if a tool should burst. Form-fit connection unit 16*k* includes several form-fit connection elements 20*k*, 22*k*, which are designed as single pieces with receiving unit 48*k*, and several form-fit connection elements 24*k*, 26*k*, which are designed as single pieces with a clamping band 74*k* of guard unit 14*k*. Form-fit connection elements 20*k*, 22*k*, 24*k*, 26*k* are designed as detent elements 28*k*, 30*k* 172*k*, 174*k*, which, when engaged, prevent guard unit 14*k* from rotating relative to hand-held power tool 12*k* in a rotation direction 108*k* of the tool. Form-fit connection elements 20*k*, 22*k* of receiving unit 48*k* are located in radial direction 70*k* downstream of an outwardly directed side 124*k* of a receiving flange 76*k* in a main element 164*k* of receiving unit 48*k*. Form-fit connection elements 24*k*, 26*k* are located on clamping band 74*k* on a side 168*k* facing main element 164*k* and away from clamping band 74*k* in a direction 176*k* away from guard body 66*k* and toward main element 164*k*. Direction 176*k* is oriented parallel to an axis 62*k* of a drive shaft 58*k*. Receiving unit 48*k* includes an intermediate ring 40*k*, which is connected with receiving flange 76*k* in a form-fit manner. To this end, receiving flange 76*k* includes several bolt-shaped coupling elements 178*k*, which are distributed in circumferential direction 36*k*, 38*k* and are supported in corresponding slots 180*k* in intermediate ring 40*k*. Slots 180*k* include—in rotation direction 108*k*—a bevel that points in direction 176*k*, which has a maximum angle of inclination to rotation direction 108*k* of 450. When guard unit 14*k* rotates, together with intermediate ring 40*k*, in rotation direction 108*k*, intermediate ring 40*k* is moved together with guard unit 14*k* in direction 176*k* of main element 164*k*, and form-fit connection elements 20*k*, 22*k*, 24*k*, 26*k* of receiving unit 48*k* and guard unit 14*k* engage in each other, thereby preventing guard unit 14*k* from rotating.

What is claimed is:

1. A hand-held power tool system comprising: a disk-shaped abrasive tool; a machine housing having a receiving flange or machine neck for carrying said tool; a guard detachably connected to said machine neck and at least partially covering said tool, said guard having a guard collar, said guard characterized by a form-fit connection unit which is provided to prevent the guard from rotating relative to the hand-held power tool, wherein the form-fit connection unit is pivotally supported on the guard by a pivot element and includes at least two form-fit connection elements or protrusions which are located one after the other in a circumferential direction and on opposite sides of the pivot element, the guard collar includes at least two correlating openings for said connection elements, said receiving flange includes 3 or more recesses, such that said guard is rotated to desired position and said connection unit is pivoted to place connection elements through openings of the collar and into two recesses of the receiving flange to provide an anti-rotation lock between the housing and guard.

2. The hand-held power tool system as defined in claim 1, wherein the at least two form-fit connection elements are connected with a driving element formed as an oscillating element and provided with an oscillating weight at a side opposite the at least two form-fit connection elements.

* * * * *